US012188161B2

(12) United States Patent
Cassigoli

(10) Patent No.: US 12,188,161 B2
(45) Date of Patent: Jan. 7, 2025

(54) METHOD AND PLANT FOR PRODUCING A FILLING MATERIAL AND FILLING MATERIAL

(71) Applicant: MINARDI PIUME S.R.L., Lugo (IT)

(72) Inventor: Carlo Cassigoli, Lugo (IT)

(73) Assignee: MINARDI PIUME S.R.L., Lugo (IT)

( * ) Notice: Subject to any disclaimer, the term of this patent is extended or adjusted under 35 U.S.C. 154(b) by 59 days.

(21) Appl. No.: 17/998,397

(22) PCT Filed: May 13, 2021

(86) PCT No.: PCT/IB2021/054110
§ 371 (c)(1),
(2) Date: Nov. 10, 2022

(87) PCT Pub. No.: WO2021/229498
PCT Pub. Date: Nov. 18, 2021

(65) Prior Publication Data

US 2023/0175175 A1 Jun. 8, 2023

(30) Foreign Application Priority Data

May 14, 2020 (IT) ..... 102020000011041

(51) Int. Cl.
*D04H 1/4382* (2012.01)
*D01G 13/00* (2006.01)
(Continued)

(52) U.S. Cl.
CPC ..... *D04H 1/43835* (2020.05); *D01G 13/00* (2013.01); *D04H 1/425* (2013.01); *D04H 1/732* (2013.01)

(58) Field of Classification Search
CPC .... D04H 1/43835; D04H 1/425; D04H 1/732; D04H 1/02; D04H 1/4266; D01G 13/00; D01G 9/00
See application file for complete search history.

(56) References Cited

U.S. PATENT DOCUMENTS 4,243,446 A * 1/1981 Mathey ..... D04H 1/4258 36/43
4,300,267 A * 11/1981 Winch ..... D01G 9/00 19/107
(Continued)

FOREIGN PATENT DOCUMENTS

DE 10346773 A1 5/2005
GB 274480 A 9/1928
(Continued)

OTHER PUBLICATIONS

Notice of Preliminary Rejection issued for Korean Patent Application No. 10-2022-7010702 dated Sep. 7, 2023.
(Continued)

*Primary Examiner* — Bao-Thieu L Nguyen
(74) *Attorney, Agent, or Firm* — Duane Morris LLP

(57) ABSTRACT

A method for producing a filling material comprising goose and/or duck down and vegetable kapok fibres comprises feeding vegetable kapok fibre to a mixing chamber (16), separating elementary kapok filaments (210) unbound from each other from the vegetable kapok fibre in the mixing chamber (16) by directing jets and/or blades of a pressurized fluid against the vegetable kapok fibre, feeding goose and/or duck down to the mixing chamber (16) and incorporating elementary kapok filaments (210) unbound from each other into the flakes (101) of goose and/or duck down (100) by mixing the elementary kapok filaments (210) and the goose and/or duck down in the mixing chamber (16) by means of said jets and/or blades of pressurized fluid fed for example by suitably oriented nozzles (33).

5 Claims, 6 Drawing Sheets

(51) Int. Cl.
*D04H 1/425* (2012.01)
*D04H 1/732* (2012.01)

(56) References Cited

U.S. PATENT DOCUMENTS 4,618,531 A 10/1986 Marcus
5,155,989 A * 10/1992 Frey ..... D01G 13/00 19/145.5
5,331,801 A * 7/1994 Heifetz ..... D01G 13/00 19/145.5
5,363,754 A * 11/1994 Coles ..... A23K 40/30 19/40
5,481,864 A * 1/1996 Wright ..... D01G 9/14 19/145.5
5,575,874 A * 11/1996 Griesbach, III .. A61F 13/51104 156/181
6,330,786 B1 * 12/2001 Settle ..... D02G 3/36 57/200
6,475,315 B1 * 11/2002 Kean ..... D04H 1/74 19/305
7,926,253 B2 * 4/2011 Tseng ..... D03D 15/00 57/256
9,885,127 B2 * 2/2018 Lightman ..... D01G 21/00
10,072,366 B2 * 9/2018 Foss ..... D04H 1/558
10,266,457 B2 * 4/2019 Spittle ..... C05G 3/80
10,301,748 B2 * 5/2019 Morgner ..... D01G 23/00
10,519,373 B2 * 12/2019 Spittle ..... C05F 11/00
10,889,758 B2 * 1/2021 Spittle ..... A01G 24/23
11,649,569 B2 * 5/2023 Saldarini ..... D01G 15/825 2/93
2004/0074052 A1 * 4/2004 Hlaban ..... G01G 19/34 19/243
2006/0010654 A1 * 1/2006 Buhl ..... A24D 3/0208 19/145.3
2006/0024470 A1 * 2/2006 Heilman ..... D04H 1/43835 428/34.3
2015/0251867 A1 * 9/2015 Higuchi ..... B65H 20/10 226/95
2017/0211209 A1 * 7/2017 Saldarini ..... A47G 9/0207
2017/0260691 A1 * 9/2017 Murayama ..... D01G 13/00
2019/0249345 A1 * 8/2019 Minehardt ..... D06M 15/263
2019/0271104 A1 * 9/2019 Mason ..... D04H 1/43838
2020/0260885 A1 * 8/2020 Stewart ..... A47G 9/0261

FOREIGN PATENT DOCUMENTS

GB 296582 A 9/1928
GB 547117 A 8/1942
GB 1012776 A 12/1965
JP 62033856 A 2/1986
KR 101398025 B1 5/2014
KR 101450655 B1 10/2014

OTHER PUBLICATIONS

International Search Report and Written Opinion for PCT Application No. PCT/IB2021/054110 issued Oct. 8, 2021, 15 pages.
Decision of Registration issued for Korean Patent Application No. 10-2022-7010702 dated Dec. 5, 2023.

* cited by examiner

METHOD AND PLANT FOR PRODUCING A FILLING MATERIAL AND FILLING MATERIAL

FIELD OF THE INVENTION

The present invention relates to a method and a plant for producing a filling material comprising waterfowl (goose and/or duck) feathers and down and kapok fibres, as well as a filling material, in particular high quality material for example for clothing, for furnishing items, for household linen, for leisure accessories.

High quality fillings must have excellent qualities of lightness, breathability and natural adaptation to the anatomical shapes. When used in clothing, household linen and leisure accessories (e.g. to make sleeping bags) the fillings must have excellent insulation properties, too.

The materials that have always been considered the best ones for producing fillings are obtained from the mantle of farmed anatidae, in particular geese and ducks.

The plumage of these birds constitutes in fact a mantle that allows them to move and survive at all temperatures. The structure of the mantle comprises feathers and down, which form tiny thermoregulatory air cells that prevent the dispersion of body heat and at the same time prevent outside air from coming into contact with the bird's skin.

In particular, the feather is made up of an axile part, the root of which is the calamus, a free part called rachis and two continuous laminae which rise from the rachis and which, with it, constitute the vexillum. The vexillum comprises numerous branches or barbs, from which depart the barbules, thin and usually very short filaments. The barbs are connected by small hooks, or hamuli, to adjacent barbs.

The down is made up of soft, light feathers, lacking calamus and rachis, in which the hooks or hamuli are also missing, so that the barbs remain independent, without forming a consistent vexillum. The barbules of the down thus form a silky, soft flake that is essentially independent and not bound to another flake. The down acts mainly as a thermal insulator.

Anatidae's down, rather than their feathers, is therefore the ideal material for fillings.

From a physical point of view, the excellent heat-insulating properties of down depend on the air trapped between the barbules of the down, by way of example, 1 gram of down occupies a volume of about 0.4 litres and is able to completely recover its volume after a compression.

Related Art

Documents KR101450655 and DE10346773 teach how to mix vegetable kapok fibre in bale form and down to make fillings.

Documents KR101398025B1 and GB 274480A disclose apparatuses for partially disentangling vegetable kapok fibres by mechanical action of variously shaped paddles.

Document GB 547117A discloses an apparatus for partially disentangling vegetable kapok fibres by mechanical action of a pair of facing screens each provided with tines, which screens are movable with respect to each other so as to partially disentangle the kapok fibres.

Document GB296582A proposes a method for mixing together vegetable kapok fibres with down wherein vegetable kapok fibre in bales is fed by suction into a mixing machine that causes partial disentangling of the vegetable kapok fibre in bale form. Down is added, during the partial disentangling operation or after this operation, in the mixing machine. Document GB296582A explains that the partial disentangling of vegetable kapok fibre in bale form is intended to create vegetable fibres, and that the addition of feathers to these partially disentangled vegetable kapok fibres would allow the barbs and barbules of the feathers to couple to these fibres. In this way, according to GB296582A, a uniform mixture of vegetable kapok fibre and down with thermal insulation properties would be created.

SUMMARY OF THE INVENTION

The Applicant has noted that the use of down as filling material has the disadvantage of very high costs, up to even a hundred euros per kilogram, with consequent high costs of the final products.

The Applicant has also observed that among the non-animal origin and very cheap alternative materials for filling materials, kapok fibres have undoubted advantages and therefore a further possibility for obtaining filling materials is given by a mixed composition of down and vegetable kapok fibre.

Vegetable kapok fibre is a very soft, silk-like fibre found inside the fruit of the tree called kapok (scientific name *Ceiba pentandra*).

The vegetable kapok fibre is usually sold in bales, the size and weight of which may vary according to demand, to be used as a low-cost (a few euros per kilogram) and completely natural filling material. The vegetable kapok fibre is about eight times lighter than cotton, incorporating about 80% air by weight in its inside.

The Applicant has verified that the vegetable kapok fibre in bale form, although having fair thermal insulating properties, is scarcely usable for producing high quality fillings, that is, fillings with good softness and provided with high thermal insulation properties.

In the Applicant's experience, although a filling in which down feathers are bound to partially mechanically disentangled vegetable kapok fibres may have thermal insulation properties, it may at the same time have a softness and homogeneity that is not adequate or at least not comparable to that of a down filling.

In particular, the Applicant has experimentally verified that the methods for mechanically disentangling the kapok fibres taught by the above-mentioned prior art allow only a partial disentangling of the fibres, which nevertheless continue to maintain a fibrous structure made of clusters of elementary filaments that are bound and entangled to each other.

In this respect, the Applicant has observed that this structure of the mechanically partially disentangled kapok fibres according to the teachings of the above-mentioned prior art does not allow to obtain any substantial intimate integration with goose or duck down, so that the resulting filling material has "lumps" of kapok fibrous material and, as such, has softness characteristics and a "hand feel" that cannot be compared with those of a filling material made of down only.

The Applicant has therefore set itself the objective of providing a filling material produced from a mixture of kapok and down, as well as a method and a plant for producing a filling material comprising a mixture of kapok and down which allows to achieve high levels of softness, thermal insulation and homogeneity.

In a first aspect thereof, the present invention therefore relates to a method for producing a filling material according to the attached claim 1.

More particularly, the present invention relates to a method for producing filling material comprising:

feeding vegetable kapok fibre to a mixing chamber;

separating elementary kapok filaments unbound from each other from the vegetable kapok fibre in said mixing chamber by directing jets and/or blades of a pressurized fluid against said vegetable kapok fibre;

feeding goose and/or duck down to said mixing chamber;

incorporating elementary kapok filaments unbound from each other into flakes of goose and/or duck down by mixing said elementary kapok filaments and said goose and/or duck down in said mixing chamber by means of said jets and/or blades of pressurised fluid.

The present invention relates, in a second aspect thereof, to a plant for producing a filling material comprising goose and/or duck down and vegetable kapok fibres.

More particularly, the present invention refers to a plant comprising:

a mixing chamber of the flakes of goose and/or duck down and of the vegetable kapok fibres;

a plurality of feeding nozzles and/or feeding slots of a pressurized fluid, in fluid communication with a pressurized fluid source, wherein each feeding nozzle and/or feeding slot faces an internal volume of the mixing chamber and is oriented to direct jets and/or blades of the pressurized fluid towards said internal volume.

The present invention refers, in a third aspect thereof, to a filling material comprising goose and/or duck down and vegetable kapok fibres.

More particularly, the present invention refers to a filling material comprising:

a) hybrid goose and/or duck down comprising elementary kapok filaments unbound from each other incorporated in flakes of goose and/or duck down (100) in an amount equal to or greater than 10% by weight of the total weight of kapok, and/or b1) goose and/or duck down, and b2) disentangled kapok fibres made of clusters of elementary kapok filaments unbound from each other and not incorporated in the down flakes, and having a weight equal to or greater than 0.05 g, in an amount equal to or lower than 20% by weight of the total weight of kapok.

In the present description and in the subsequent claims, the term "softness" ("fill power") when referred to the filling material, is intended to mean the ability of the material to recover its initial volume after being subjected to a compressive action.

In the present description and in the subsequent claims, the term "elementary filament" of kapok is intended to mean a single filament of kapok fibre that is not entangled and not aggregated with other filaments of kapok fibre.

In the present description and in the subsequent claims, the term "vegetable fibre" of kapok is intended to mean an assembly of elementary kapok filaments that are bound to each other and entangled to form a cluster of elementary filaments.

Within the framework of the present description and of subsequent claims, therefore, a vegetable fibre or cluster of elementary filaments is physically distinct from another vegetable fibre or cluster of elementary filaments. Two vegetable kapok fibres or clusters of elementary kapok filaments can be physically separated from each other.

In the present description and in the subsequent claims, the term "hybrid goose and/or duck down", "hybrid down", "hybrid down flake" or "hybrid down flake" is intended to mean a down or down flake incorporating at least one elementary kapok filament, for example one or more elementary filaments inserted between the barbules of the down.

Within the framework of the present description and of the subsequent claims, all the numerical entities indicating quantities, parameters, percentages, and so forth are to be considered preceded in every circumstance by the term "about" unless indicated otherwise.

Further, all the ranges of numerical entities include all the possible combinations of maximum and minimum numerical values and all the possible intermediate ranges, in addition to those specifically indicated below.

The Applicant has surprisingly found that it is possible to produce a filling material having thermal, softness and homogeneity properties similar to those of the fillings made entirely of down, at a reduced production cost and with improved environmental sustainability compared to the fillings made entirely of down, by separating elementary kapok filaments unbound from each other from vegetable kapok fibre and by incorporating said elementary filaments into goose and/or duck down flakes.

According to the invention, the separation of the elementary kapok filaments unbound from each other from the vegetable kapok fibre and the incorporation of significant amounts of these elementary filaments into the goose and/or duck down flakes can be advantageously achieved by the sole action of jets and/or blades of a pressurized fluid without necessarily having the intervention of mechanical means on the vegetable kapok fibre or on the goose and/or duck down as instead taught by the prior art mentioned above.

The Applicant has in fact experimentally found that, thanks to the action of the aforementioned jets and/or blades of pressurized fluid, it is possible both to separate the elementary kapok filaments from the fibres and to effectively promote the insertion of the filaments between the barbules of the down.

In this way, the elementary kapok filaments intertwine and remain effectively coupled to the down barbules, creating a hybrid flake that stably integrates the elementary kapok filaments into the down flake itself.

Unlike the filling materials that use partially disentangled vegetable fibres in a mechanical way, this hybrid flake, composed of a feather and of elementary kapok filaments hooked to the down barbules, maintains substantially the same properties of a down flake, the elementary kapok filaments being substantially smaller than the down flake and therefore unable to modify in a substantial way the shape and the characteristics typical of a down flake.

In this respect, the Applicant has found that in a filling material having substantially the same properties of softness and homogeneity of a filling material consisting of down only, the amount of elementary kapok filaments unbound from each other incorporated into the down flakes is equal to or greater than 10% by weight of the total weight of kapok.

Without wishing to be bound by any interpretative theory, the Applicant believes that the jets and/or blades of pressurized fluid, when they come in contact with the vegetable kapok fibre, create high-energy, high-turbulence flows capable of exerting a dual beneficial effect of:

i) penetrating into the starting not disentangled vegetable kapok fibres by separating elementary filaments which are kept in a separate condition so that they can subsequently be effectively inserted between the barbules of the down; and ii) disentangling the starting vegetable kapok fibres by creating disentangled fibres made of clusters of elementary filaments bound to each other more loosely than the starting fibres.

Within the framework of the present invention, the Applicant has also found that disentangled fibres made of clusters of elementary filaments bound to each other more loosely than the starting fibres, for example disentangled fibres obtained in the aforesaid step of separating the elementary kapok filaments by directing jets and/or blades of a pressurized fluid against the original not disentangled vegetable kapok fibre as described above, have a weight equal to or lower than 0.05 grams.

In this respect, the Applicant has experimentally found that such disentangled fibres made of clusters of elementary filaments having a weight equal to or lower than 0.05 grams, when mixed with the down to produce a filling, do not create lumps in the filling, giving the latter excellent softness and high thermal insulation properties. This, regardless of the presence of elementary kapok filaments unbound from each other in the down flakes.

The Applicant has in particular found that in a filling material comprising goose and/or duck down and vegetable kapok fibres having substantially the same softness and hand feel properties of a filling material consisting of down only, the amount of disentangled vegetable kapok fibres having a weight equal to or greater than 0.05 grams is equal to or lower than 20% by weight of the total weight of kapok.

The Applicant has in fact verified that high quality fillings are obtained not only by mixing elementary kapok filaments unbound from each other and goose and/or duck down, but also by mixing to the down disentangled fibres made of clusters of filaments having a weight equal to or lower than 0.05 grams.

In fact, the Applicant has observed that the disentangled fibres made of clusters of elementary filaments having a weight equal to or lower than 0.05 grams are less "ordered", i.e. they are made of clusters of elementary filaments more randomly oriented in space around an aggregation core, both with respect to the clusters typical of the starting not disentangled vegetable kapok fibres, usually provided in the form of a bale, and with respect to the vegetable kapok fibres that are disentangled in a purely mechanical way as taught by the prior art.

Without wishing to be bound by any interpretative theory, the Applicant believes that the disentangled fibres made of clusters of elementary filaments having a weight equal to or lower than 0.05 grams, for example the disentangled fibres obtained according to the method of the present invention, interact with each other and with downs in a manner different from that of the starting not disentangled kapok fibres or of the purely mechanically disentangled fibres.

In this respect, the Applicant has in fact experimentally verified that disentangled fibres made of clusters of elementary filaments having a weight equal to or lower than 0.05 grams tend to recover their undeformed shape better than purely mechanically disentangled fibres that include substantial amounts of clusters of elementary filaments having a weight greater than 0.05 g.

The filling material comprising the disentangled fibres made of clusters of elementary filaments having a weight equal to or lower than 0.05 grams according to the invention, has in fact an overall degree of softness and homogeneity which is much higher than that obtainable with vegetable kapok fibres disentangled in a purely mechanical manner according to the prior art.

Advantageously, the jets and/or blades of pressurized fluid directed against the starting vegetable kapok fibre exert an effect of disentangling the fibre and of separating elementary filaments that minimises the possibility of degrading or breaking the kapok fibre compared to the action of mechanical disentangling means that are provided by the prior art.

In this way, it is therefore advantageously possible to minimise the generation of fibre dust or fragments that are not useful for achieving the desired softness and insulation effects of the filling material.

Advantageously, furthermore, the effect of a sufficiently disentangling of the starting kapok fibre and of separating the elementary filaments from the fibre is also achieved by the jets and/or blades of pressurized fluid directed against the fibre in a relatively short time.

According to the invention, by selecting a suitable weight percentage of vegetable kapok fibre and down, it is possible to obtain a filling product having properties more or less similar to a filling made entirely of down.

In particular, by increasing the percentage by weight of down at the expense of the percentage by weight of kapok, the resulting filling material has properties more similar to a filling made entirely of down. By decreasing the percentage by weight of down in favour of the percentage by weight of kapok, the resulting filling material has properties that are further away from those of a filling made entirely of down, while maintaining excellent softness and thermal insulation properties.

The present invention may comprise, in one or both aspects thereof, one or more of the following preferred features, taken individually or in combination.

Preferably, the elementary kapok filaments unbound from each other are incorporated into the flakes of goose and/or duck down in an amount equal to or greater than 15% by weight, 20% by weight, 25% by weight, 30% by weight, 35% by weight or 40% by weight, of the total weight of kapok.

Preferably, the elementary kapok filaments unbound from each other are incorporated into the flakes of goose and/or duck down in an amount equal to or lower than 95% by weight, 90% by weight, 85% by weight, 80% by weight, 75% by weight or 70% by weight, of the total weight of kapok.

Preferably, the vegetable kapok fibres comprise an amount of clusters of elementary kapok filaments, not incorporated into the down flakes and having a weight equal to or greater than 0.05 grams, equal to or lower than 15% by weight, 10% by weight, 9% by weight, 8% by weight, 7% by weight, 6% by weight, 5% by weight, 4% by weight, 3% by weight, 2% by weight or 1% by weight, of the total weight of vegetable kapok fibres.

More preferably, the vegetable kapok fibres comprise an amount of clusters of elementary kapok filaments, not incorporated into the down flakes and having a weight equal to or greater than 0.05 grams, equal to 0%.

In this way, it is advantageously possible to achieve optimum softness characteristics of the resulting filling material.

Preferably, the filling material comprises an amount of vegetable kapok fibres between 5% and 80% by weight, preferably between 10% and 75% by weight, more preferably between 10% and 50% by weight, of the total weight of the filling material.

In this way, it is advantageously possible to achieve an optimum compromise between the quality of the resulting filling material and the production cost.

The Applicant has in fact observed that in order to obtain a material having very similar characteristics to those of down, the mixture must have a number of down flakes sufficient to act as a receptacle for the elementary kapok filaments.

In this regard, the Applicant has verified that when the amount of vegetable kapok fibres exceeds 80% by weight of the total weight of the filling material the properties in terms of softness, homogeneity and thermal insulation of the resulting material may degrade excessively for a use comparable to the use that is made of the filling material composed of down only.

Preferably, separating the elementary kapok filaments unbound from each other from the vegetable kapok fibre comprises forming disentangled vegetable kapok fibre made of clusters of elementary filaments bound to each other and having a weight equal to or lower than 0.05 grams.

In this way, and as explained above, it is advantageously possible to obtain in a single operation both the separation of elementary kapok filaments and the formation of disentangled vegetable kapok fibres which, when mixed with down, allow to obtain a high quality filling material.

The disentangled vegetable kapok fibres having a weight equal to or lower than 0.05 grams have in fact a lower density of elementary filaments which also tend to reorient themselves more randomly around an aggregation core, producing disentangled fibres having optimum properties for the filling material.

Preferably, separating the elementary kapok filaments unbound from each other from the vegetable kapok fibre comprises obtaining a percentage by weight of elementary kapok filaments between 30% and 90% by weight, more preferably between 40% and 70% by weight, for example of about 50% by weight, of the total weight of the vegetable kapok fibres.

Advantageously, this allows to obtain a high-quality filling material even by using substantial quantities of kapok.

As mentioned above, in fact, the hybrid flakes which are formed essentially have the same softness and thermal insulation properties of down, while the disentangled fibres made of clusters of elementary filaments having a weight equal to or lower than 0.05 grams impart to the filling excellent softness and high thermal insulation properties even without being integrated into the down.

In this way, i.e. by mixing the down with the mixture of elementary kapok filaments and disentangled kapok fibres having a weight equal to or lower than 0.05 grams, it is possible to avoid very complex processes of a separate collection of elementary kapok filaments and of disentangled kapok fibres.

Preferably, incorporating the elementary kapok filaments into the flakes of goose and/or duck down takes place in the aforesaid mixing chamber simultaneously with separating the elementary kapok filaments unbound from each other from the vegetable kapok fibre.

In this way, it is advantageously possible to have maximum efficiency in the preparation of hybrid downs with a reduction in the time required to produce the filling material.

Preferably, the method of the invention comprises mixing the disentangled vegetable kapok fibres having a weight equal to or lower than 0.05 grams with goose and/or duck down.

In this way and as explained above, it is advantageously possible to obtain a high-quality filling material even without necessarily having to transform the entire starting vegetable kapok fibre into elementary filaments.

Preferably, incorporating the elementary kapok filaments unbound from each other into the flakes of goose and/or duck down and mixing the disentangled vegetable kapok fibres having a weight equal to or lower than 0.05 grams with the goose and/or duck down take place simultaneously.

In this way, it is advantageously possible to have the maximum efficiency in the preparation of the filling material with a reduction in the time required for the production thereof.

Preferably, separating the elementary kapok filaments unbound from each other from the vegetable kapok fibre is carried out by holding the vegetable kapok fibre in suspension in the mixing chamber.

In this way, it is advantageously possible to have the maximum effectiveness in separating the elementary kapok filaments from the vegetable kapok fibre and in obtaining disentangled fibres having a weight equal to or lower than 0.05 grams thanks to the action of the jets and/or of the blades of a pressurized fluid on a mass constantly maintained in a condition of turbulence.

Preferably, incorporating elementary kapok filaments unbound from each other into flakes of the goose and/or duck down is carried out by holding the elementary kapok filaments and the goose and/or duck down in suspension in said mixing chamber.

Preferably, mixing the disentangled vegetable kapok fibres with said goose and/or duck down is carried out by holding the disentangled vegetable kapok fibres and the goose and/or duck down in suspension in the mixing chamber.

According to each of these last two preferred embodiments, it is advantageously possible to have the maximum efficiency in the preparation of hybrid downs and of the filling material with a reduction in the time required for the production thereof.

Preferably, holding the elementary kapok filaments, the goose and/or duck down or the disentangled vegetable kapok fibres in suspension is at least partially carried out by means of the aforesaid jets and/or blades of the pressurized fluid.

In this way, it is advantageously possible to have the maximum efficiency in the preparation of the filling material with a reduction in the time required for the production thereof.

In a preferred embodiment of the invention, therefore, the aforementioned jets and/or blades of the pressurized fluid advantageously exert three simultaneous effects:

i) maintaining under stirring the heterogeneous mass consisting of the vegetable kapok fibre and down;
ii) separating elementary kapok filaments unbound from each other from the vegetable kapok fibre;
iii) mixing the kapok elementary filaments unbound from each other, the disentangled vegetable kapok fibres and the flakes of goose and/or duck down by incorporating the kapok elementary filaments into the down flakes and by mixing the hybrid down flakes with disentangled vegetable kapok fibres having optimum characteristics for use in a filling material.

Preferably, holding the elementary kapok filaments, the goose and/or duck down or the disentangled vegetable kapok fibres in suspension is at least partially carried out by means of a comb rotating within the mixing chamber.

In this way, it is advantageously possible to assist the action of the jets and/or blades of the pressurized fluid in holding in suspension the elements to be mixed and/or integrated with each other (the elementary kapok filaments, the goose and/or duck down and the disentangled vegetable kapok fibres), while the simultaneous presence of the jets and/or blades of the pressurized fluid minimises any undesirable mechanical degradation phenomena of the kapok.

Preferably, directing jets and/or blades of a pressurized fluid against said vegetable kapok fibre comprises feeding said pressurized fluid into said mixing chamber at a pressure equal to or greater than 0.1 MPa.

More preferably, directing jets and/or blades of a pressurized fluid against said vegetable kapok fibre comprises feeding said pressurized fluid into said mixing chamber at a pressure between 0.2 MPa and 2 MPa, even more preferably between 0.3 and 1.0 MPa, for example of about 0.7 MPa.

In this way, it is advantageously possible to achieve the technical effects described above and attributable to the jets and/or blades of pressurized fluid.

The Applicant, in fact, believes that the pressurized fluid, e.g., compressed air, fed into the mixing chamber creates high-energy, high-turbulence air flows that promote a swirling motion of the down flakes and of the elementary kapok filaments, which promotes and speeds up the adhesion of the elementary kapok filaments to the down barbules with incorporation of the former into the down.

Preferably, the pressurized fluid feeding time is longer than two minutes, more preferably longer than three minutes, for example is of about ten minutes.

The Applicant has found that after a maximum feeding time of the pressurized fluid of about 20 minutes, the degree of mixing between the down and the elementary kapok filaments does not substantially increase.

The feeding of the pressurized fluid can be continuous or intermittent. Preferably, the feeding of the pressurized fluid is continuous.

Preferably, directing jets and/or blades of a pressurized fluid against the vegetable kapok fibre comprises feeding compressed gas, preferably compressed air, into the mixing chamber by means of a plurality of feeding nozzles and/or feeding slots.

In this way, it is advantageously possible to achieve highly directed flows of pressurized fluid that achieve the technical effects described above in an optimal way.

By way of example, a substantially cylindrical mixing chamber having a length of about 3 metres and a diameter of about 2 metres may be provided with a number of feeding nozzles and/or feeding slots between 4 and 18, preferably 8 feeding nozzles and/or feeding slots.

As explained above, each feeding nozzle and/or feeding slot faces an internal volume of the mixing chamber and is oriented to direct jets and/or blades of the pressurized fluid towards said internal volume.

Preferably, the feeding nozzles and/or feeding slots of the pressurized fluid are arranged according to one or more pairs mutually positioned at substantially opposite, more preferably longitudinally opposite, parts of the mixing chamber.

In this way, it is advantageously possible to achieve highly directed and oriented flows of pressurized fluid in such a way that the technical effects described above are achieved in an optimal way.

In a preferred embodiment, the mixing chamber is defined in a mixing cylinder, preferably a static cylinder.

Preferably, the mixing cylinder has a perforated side wall and the feeding of the pressurized fluid in the form of jets and/or blades takes place within said mixing cylinder.

In this preferred embodiment, the feeding nozzles and/or feeding slots of the pressurized fluid are arranged in pairs substantially opposite to each other and facing an internal volume of the mixing cylinder.

Preferably, the ratio between the weight in kilograms given by the sum of the weight of the down and the mixture of elementary kapok filaments and disentangled kapok fibres fed into the mixing chamber and the volume of the mixing chamber measured in cubic meters is between 0.2 and 5.

More preferably, this ratio is between 0.2 and 3.0, even more preferably between 0.3 and 2, for example between 0.5 and 1.5.

This ratio, in the Applicant's experience, ensures that there is sufficient volume within the mixing chamber to allow the elementary kapok filaments to bind to the down barbules.

Preferably, the down, the elementary filaments and the disentangled kapok fibres are fed simultaneously and continuously into the mixing chamber.

The Applicant has verified that during the feeding of compressed gas it is preferable that the vegetable kapok fibre be confined within a mixing chamber, both to maximise the turbulence generated and to prevent that kapok fibres may be dispersed into the environment.

Preferably, feeding the vegetable kapok fibre to the mixing chamber comprises feeding in succession and continuously portions of the vegetable kapok fibre, wherein each portion is a fraction of the entire amount of vegetable kapok fibre in bale form to be processed.

Preferably, the mass flow rate of the kapok fed to the mixing chamber is between 0.5 kg/min and 1.5 kg/min, more preferably is of about 1 kg/min.

In this way, it is advantageously possible to use a mixing chamber having a small size to disentangle even large quantities of vegetable kapok fibre in bale form and to mix the obtained kapok filaments and disentangled kapok fibres with the down.

In this way, it is advantageously possible to achieve an optimal compromise between the softness characteristics of the filling material and the reduction of the production costs of the latter.

In a preferred embodiment, the method according to the invention comprises subjecting the vegetable kapok fibre to partial disentangling before feeding the vegetable kapok fibre to the mixing chamber.

In this way, it is advantageously possible to maximise the efficiency of the subsequent steps of separating the elementary kapok filaments unbound from each other from the vegetable kapok fibre and of forming disentangled kapok fibres made of clusters of elementary filaments bound to each other and having a weight equal to or lower than 0.05 grams, which take place in the aforesaid mixing chamber with the down.

Preferably, and similarly to what occurs in the mixing chamber, this partial disentangling of the vegetable kapok fibre comprises directing jets and/or blades of a pressurized fluid against the vegetable kapok fibre along a feeding path of the vegetable kapok fibres to the mixing chamber.

In this way and as set forth above, the Applicant believes that said jets and/or blades of pressurized fluid, when they come in contact with the vegetable kapok fibre, create high-energy, high-turbulence flows capable of exerting a dual beneficial effect of:

i) penetrating the starting not disentangled vegetable kapok fibres by beginning to separate elementary filaments capable of effectively inserting themselves between the down barbules in the subsequent mixing step with the down; and ii) disentangling the aforesaid starting vegetable kapok fibres by creating disentangled fibres made of clusters of elementary filaments bound to each other looser than the starting fibres and having a weight equal to or lower than 0.05 grams.

Also in this case, the feeding of the pressurized fluid, for example compressed air, can be continuous or intermittent. Preferably, the blowing of the pressurized fluid is continuous.

Preferably, the aforesaid partial disentangling of the vegetable kapok fibre comprises directing jets and/or blades of a pressurized fluid against the vegetable kapok fibre in a pre-treatment chamber positioned upstream of the mixing chamber with the down.

In this way, it is advantageously possible both to achieve the advantageous technical effects highlighted above and to confine the vegetable kapok fibre inside a chamber, the treatment chamber, which allows both to maximise the turbulence generated by the jets and/or blades of the pressurized fluid and to prevent that the elementary filaments and the disentangled kapok fibres may be dispersed into the environment.

Preferably, directing jets and/or blades of a pressurized fluid against the vegetable kapok fibre comprises feeding compressed gas, preferably compressed air, in the feeding path of the vegetable kapok fibres to the mixing chamber or in the pre-treatment chamber by means of a plurality of feeding nozzles and/or feeding slots.

In this way, it is advantageously possible to obtain highly directed flows of pressurized fluid that achieve the technical effects described above in an optimal way.

Preferably, the feeding nozzles and/or feeding slots of the pressurized fluid in the pre-treatment chamber are arranged in pairs substantially opposite to each other and facing an internal volume of the feeding path of the vegetable kapok fibres to the mixing chamber or of the pre-treatment chamber.

In this way, it is advantageously possible to achieve highly directed and oriented flows of pressurized fluid in such a way that a partial disentangling effect of the vegetable kapok fibre is optimally achieved.

Preferably, subjecting the vegetable kapok fibre to partial disentangling is carried out by holding the vegetable kapok fibre in suspension in the feeding path of the vegetable kapok fibres to the mixing chamber or in the pre-treatment chamber.

In this way, it is advantageously possible to have the highest partial disentangling efficiency of the vegetable kapok fibre.

Preferably, holding the vegetable kapok fibre in suspension in the feeding path of the vegetable kapok fibres to the mixing chamber or in the pre-treatment chamber is at least partially carried out by means of said jets and/or blades of pressurized fluid.

In this way, it is advantageously possible to have the highest partial disentangling efficiency of the vegetable kapok fibre.

Preferably, holding the vegetable kapok fibre in suspension in the pre-treatment chamber is at least partially carried out by means of a comb rotating within the pre-treatment chamber of the vegetable kapok fibre.

In this way, it is advantageously possible to assist the action of the jets and/or blades of the pressurized fluid in holding in suspension the vegetable kapok fibre to be subjected to partial disentangling, while the simultaneous presence of the jets and/or blades of the pressurized fluid minimises any undesirable mechanical degradation of the kapok.

Preferably, directing jets and/or blades of a pressurized fluid against said vegetable kapok fibre comprises feeding said pressurized fluid in the feeding path of the vegetable kapok fibres to the mixing chamber or in the pre-treatment chamber at a pressure equal to or greater than 0.1 MPa.

More preferably, directing jets and/or blades of a pressurized fluid against said vegetable kapok fibre comprises feeding said pressurized fluid in the feeding path of the vegetable kapok fibres to the mixing chamber or in the pre-treatment chamber at a pressure between 0.2 MPa and 2 MPa, even more preferably between 0.3 and 1.0 MPa, for example at a pressure of about 0.7 MPa.

In this way, it is advantageously possible to achieve in an adequate way the technical effects described above and attributable to the jets and/or blades of the pressurized fluid acting in the feeding path of the vegetable kapok fibres to the mixing chamber or in the pre-treatment chamber.

The Applicant, in fact, believes that the pressurized fluid, e.g., compressed air, fed into the feeding path of the vegetable kapok fibres to the mixing chamber, or into the pre-treatment chamber, creates high-energy, high-turbulence air flows that promote a swirling motion of the vegetable kapok fibres that favours both their partial disentangling and the separation of elementary filaments.

Preferably, the residence time of the vegetable kapok fibres in the feeding path of the vegetable kapok fibres to the mixing chamber or in the pre-treatment chamber is between 1 second and 1 minute.

The feeding of the pressurized fluid in the feeding path of the vegetable kapok fibres to the mixing chamber or in the pre-treatment chamber can be continuous or intermittent. Preferably, the feeding of the pressurized fluid is continuous.

Preferably, the ratio between the weight in kilograms of the vegetable kapok fibre present in the pre-treatment chamber and the volume of the pre-treatment chamber measured in cubic metres is between 0.5 and 10.0, more preferably between 0.5 and 8.0, even more preferably between 1.0 and 6.0, for example between 2.0 and 5.0.

This ratio, in the Applicant's experience, ensures that there is sufficient volume within the pre-treatment chamber to allow the starting vegetable kapok fibres, for example in bale form, which are to be disentangled to be efficiently separated into elementary filaments and disentangled fibres.

Preferably, depending on the size of the pre-treatment chamber, the starting kapok fibre in bale form may be totally introduced into the pre-treatment chamber or may be introduced into the pre-treatment chamber in successive portions.

Preferably, the starting kapok fibre in bale form is loaded in successive portions so as to optimise the disentangling effect of the jets and/or blades of pressurized fluid.

Preferably, the mass flow rate of the kapok fed to the pre-treatment chamber is between 0.5 kg/min and 1.5 kg/min, more preferably is of about 1 kg/min.

The amount by weight of the bale of vegetable kapok fibre present in the pre-treatment chamber with respect to the volume of the pre-treatment chamber is anyhow within the above-mentioned preferred range.

Preferably, the mixture of elementary filaments and disentangled fibres obtained by partially disentangling the bale of vegetable kapok fibres in the pre-treatment chamber is immediately sent to the mixing chamber to be mixed with the down.

Preferably, the mixture of elementary filaments and disentangled kapok fibres is continuously fed to the mixing chamber, for example in the mixing cylinder mentioned above.

In the case where the starting kapok fibre in bale form is fed in successive portions to the pre-treatment chamber, it is preferably envisaged taking the mixture of elementary filaments and disentangled fibres from the pre-treatment chamber and sending the mixture to the mixing chamber during the disentangling of each portion of the bale of vegetable kapok fibres.

In this way, successive portions of vegetable kapok fibre in bale form can be fed into the pre-treatment chamber in succession and continuously.

Preferably, the mixture of elementary filaments and disentangled fibres is transferred through a pneumatic transfer line connecting an outlet of the pre-treatment chamber to an inlet of the mixing chamber with the down.

In this way, as soon as the elementary filaments and the disentangled fibres are formed, they are directly transferred, without settling at the bottom of the pre-treatment chamber, to the mixing chamber.

Preferably, the pneumatic transfer line is activated substantially at the same time as the kapok fibre is introduced into the pre-treatment chamber.

Preferably, in order to prevent the kapok fibre not yet disentangled from being carried away by the pneumatic transfer line, it is envisaged to arrange at least one, preferably two, feeding nozzles of pressurized fluid at the inlet of the pneumatic line in the pre-treatment chamber.

In the preferred embodiment of the invention, the plant may further comprise:

- a pre-treatment chamber of the vegetable kapok fibre positioned upstream of the mixing chamber;
- a plurality of feeding nozzles and/or feeding slots of a pressurized fluid, in fluid communication with a pressurized fluid source, wherein each feeding nozzle and/or feeding slot faces an internal volume of the pre-treatment chamber and is oriented to direct jets and/or blades of the pressurized fluid towards said internal volume.

Preferably, the feeding nozzles and/or feeding slots are arranged according to one or more pairs positioned at substantially opposite parts of the pre-treatment chamber.

In this way, it is advantageously possible to achieve the technical effects illustrated above with reference to the preferred embodiments of the method for producing the filling material which involve a step of partial disentangling the starting vegetable kapok fibres.

Preferably, directing jets and/or blades of a pressurized fluid against the vegetable kapok fibre comprises arranging the feeding nozzles and/or feeding slots so as to direct the jets and/or blades of compressed air towards the centre of the pre-treatment chamber.

The feeding nozzles and/or feeding slots may be arranged on the side walls of the pre-treatment chamber so as to direct the jets and/or blades of pressurized fluid towards the centre of the pre-treatment chamber to intercept the kapok fibre contained therein.

By way of example, a substantially prismatic container having dimensions of approximately 1.4 metres×0.7 metres×0.4 metres may be provided with a number of feeding nozzles and/or feeding slots between 4 and 18, preferably of 8 feeding nozzles and/or feeding slots.

Preferably, the pre-treatment chamber of the vegetable kapok fibre is defined in a container of a pre-treatment apparatus of the vegetable kapok fibre positioned upstream of the mixing chamber or in a feeding conduit of the vegetable kapok fibre to the mixing chamber.

Finally, in preferred embodiments, the plant may further comprise a comb rotating within the mixing chamber and/or within the pre-treatment chamber of the vegetable kapok fibre.

BRIEF DESCRIPTION OF THE FIGURES

Additional features and advantages of the invention will be more readily apparent from the following description of preferred embodiments thereof made with reference to the attached drawings, wherein.

DETAILED DESCRIPTION OF PRESENTLY PREFERRED EMBODIMENTS OF THE INVENTION

Figure 1:
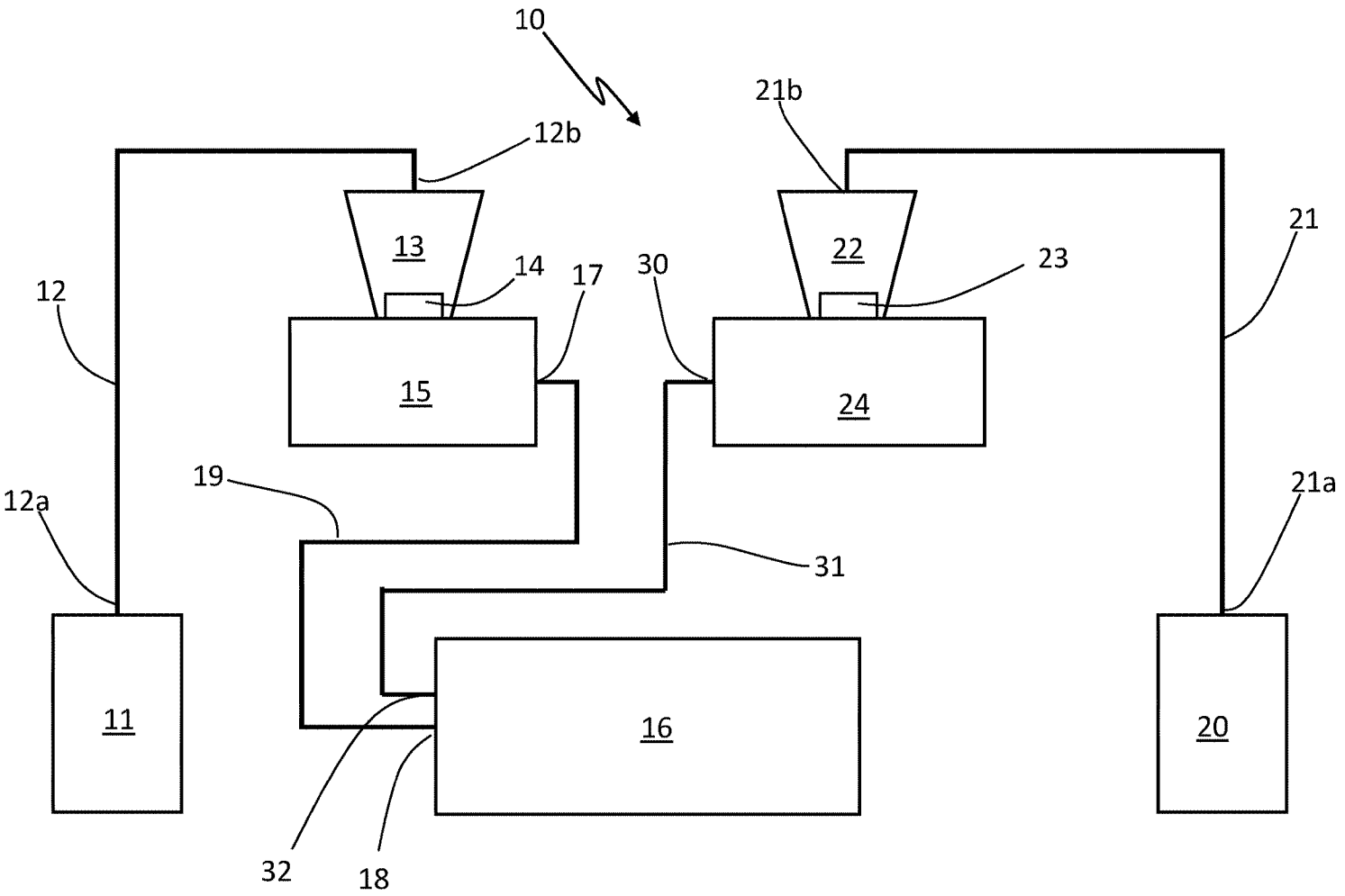
FIG. 1 is a diagram of a possible preferred embodiment of a plant for carrying out a method for producing filling material according to the present invention.

FIG. 1 schematically illustrates a preferred embodiment of a plant 10 for producing a filling material comprising elementary kapok filaments unbound from each other incorporated in flakes of goose and/or duck down according to the present invention.

For the sake of simplicity, the plant 10 will be illustrated below with reference to a preferred embodiment of a method according to the invention for producing a filling material comprising elementary kapok filaments unbound from each other incorporated in flakes of goose and/or duck down to form hybrid flakes.

Preferably, the method for producing filling material comprises introducing an amount of down 100 into a collector device 11.

The amount of down introduced into the collector device 11 is not necessarily predetermined but may for example be the amount of down 100 contained in one or more bags typically used for the sale of down 100.

The down 100 is goose and/or duck down and is mostly in the form of flakes 101.

Figure 6:
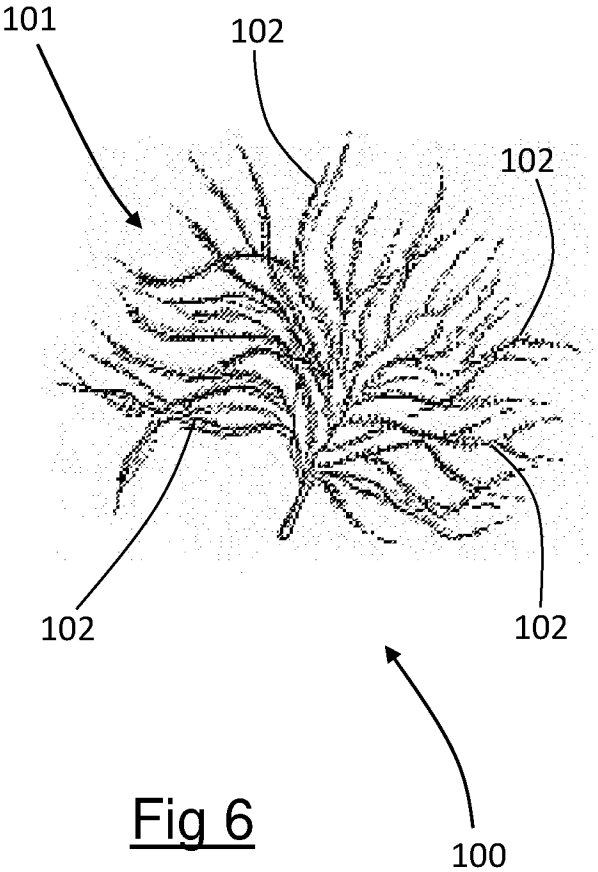
FIG. 6 is a schematic view of a down flake.

FIG. 6 schematically illustrates the typical, but not exclusive structure of such a flake 101. The flake 101 is devoid of calamus and rachis and comprises a plurality of substantially independent barbs or barbules 102 which do not form a consistent vexillum. The barbules 102 of the flake 101 have a substantially elongated shape to form an open canopy-like structure.

The down 100 introduced into the collector device 11 is transferred by a pneumatic loading line 12 into a hopper 13. A weighing device 14, for example a load cell, is provided at the base of the hopper 13.

The pneumatic loading line 12 creates a forced-air transport line that transports the down from the collector device 11 to the hopper 13. The pneumatic loading line 12 may be a conduit with diameter preferably between 10 and 30 centimetres, for example 20 centimetres, in which a pressure difference is created between inlet 12*a* and outlet 12*b*, for example by using an air blower such as a fan. The inlet 12*a* is located at the collector device 11 and the outlet 12*b* is located at the hopper 13. The pressure difference is such that the pressure at the inlet 12*a* is lower than the ambient pressure and the pressure at the outlet 12*b*, so as to create an air flow that transports the down 100 into the hopper 13.

The weighing device 14 has the function of weighing a predetermined amount of down 100 as a function of the type of filling to be produced.

In a working example to which reference will be made, the amount of down 100 used is equal to 70% by weight with respect to the total weight of the filling material.

In the example described, the filling material has a total weight of 5 kg. Thus, the weighing device 14 is set to weigh 3.5 kg of down 100.

The down 100 thus weighed is sent to a conveyor device (not illustrated), such as for example a conveyor belt, to be transferred to a homogenization container 15.

The function of the homogenization container 15 is to stir the down 100 in such a way as to separate the flakes 101 from each other (at least in part), to prevent the formation of agglomerates of flakes 101 and to separate any agglomerates of flakes 101 into single flakes 101 or at least into smaller agglomerates of flakes 101.

An example of a homogenization container 15 may be a container within which a plurality of paddles or combs rotate that intercept the down 100 stirring the latter and separating the down flakes from each other.

The stirred down 100 is sent to a mixing chamber 16.

To this end, the homogenization container 15 comprises an outlet 17 for the stirred down. The outlet 17 is connected to an inlet 18 of the mixing chamber 16 through a pneumatic feeding line 19. The pneumatic feeding line 19 may be a conduit having a diameter between 10 and 30 centimetres, for example 20 centimetres, in which a pressure difference is created between the outlet 17 from the homogenization container 15 and the inlet 18 into the mixing chamber 16, for example by using an air blower such as a fan. The pressure difference is such that the pressure at the outlet 17 is lower than the pressure at the inlet 18, so as to create an air flow that transports the stirred down 100 into the mixing chamber 16.

Alternatively, the down 100 may be directly sent to the mixing chamber 16 without being introduced into the homogenization container 15. In this case, the down 100 weighed in the weighing device 14 is directly introduced into the mixing chamber 16 for example through a conduit in which a flow of transport air moves through or by dropping from the weighing device 14.

The method for producing the filling material also envisages introducing an amount of vegetable kapok fibre into a collector device 20. The amount of vegetable kapok fibre introduced into the collector device 20 is not necessarily predetermined but may for example be the amount of vegetable kapok fibre contained in one or more bags typically used for the sale of vegetable kapok fibre.

The vegetable kapok fibre introduced into the collector device 20 is transferred by a pneumatic kapok loading line 21 into a hopper 22. A weighing device 23, for example a load cell, is provided at the base of the hopper 22.

The pneumatic kapok loading line 21 creates a forced-air transport line that transports the vegetable kapok fibre from the collector device 20 to the hopper 22. The pneumatic kapok loading line 21 may be a conduit with diameter between 10 and 30 centimetres, for example 20 centimetres, in which a pressure difference is created between inlet 21*a* and outlet 21*b*, for example by using an air blower such as a fan. The inlet 21*a* is placed at the collector device 20 dedicated to the kapok and the outlet 22*b* is placed at the hopper 22 dedicated to the kapok. The pressure difference is such that the pressure at the inlet 21*a* is lower than the ambient pressure and the pressure at the outlet 21*b*, so as to create an air flow that transports the vegetable kapok fibre into the hopper 22.

The weighing device 23 has the function of weighing a predetermined amount of vegetable kapok fibre as a function of the type of filling to be produced.

In the example to which reference is made, the amount of vegetable kapok fibre used is equal to 30% by weight with respect to the total weight of the filling material.

Thus, the weighing device 23 is set to weigh 1.5 kg of vegetable kapok fibre.

In a preferred embodiment, the vegetable kapok fibre thus weighed is sent to a conveyor device (not illustrated), such as for example a conveyor belt, to be transferred in a pre-treatment chamber 24.

In the preferred embodiment illustrated in the figures, the pre-treatment chamber of the vegetable kapok fibre 24 is defined in a container of a pre-treatment apparatus of the vegetable kapok fibre positioned upstream of the mixing chamber 16 and comprising, in this exemplary embodiment, the hopper 22 and the weighing device 23.

In this preferred embodiment, the vegetable kapok fibre is subjected to partial disentangling in the pre-treatment chamber 24 to obtain elementary kapok filaments 210 and disentangled vegetable kapok fibres 220 made of clusters of elementary filaments bound to each other and having a weight equal to or lower than 0.05 grams.

Figure 7:
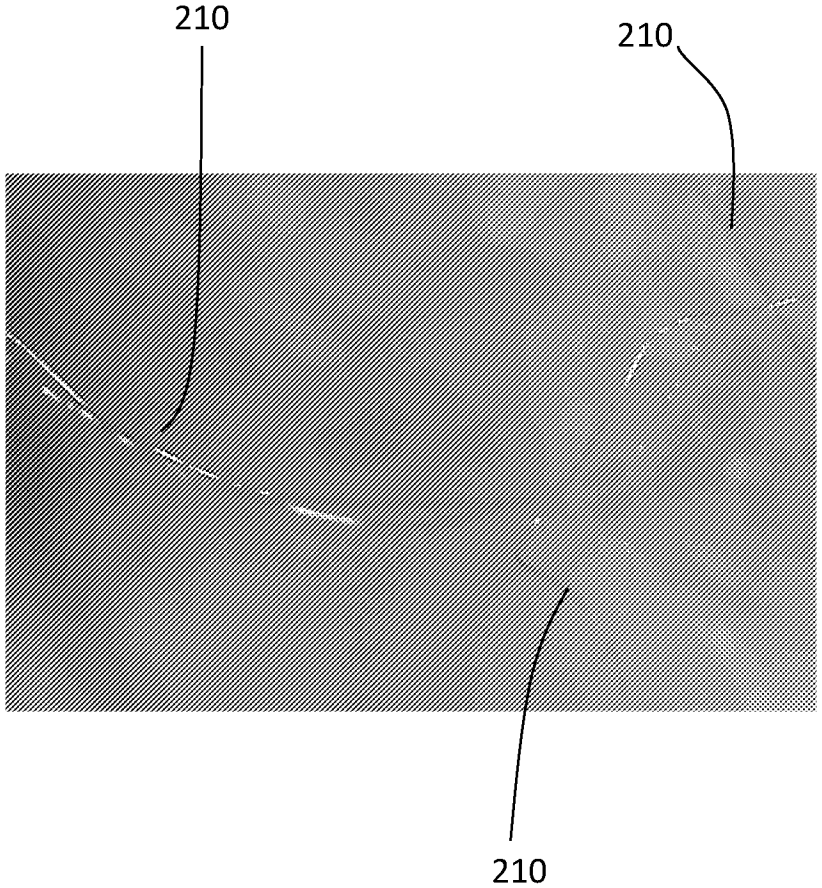
FIG. 7 is a 20-fold magnified view of an elementary kapok filament.
Figure 8:
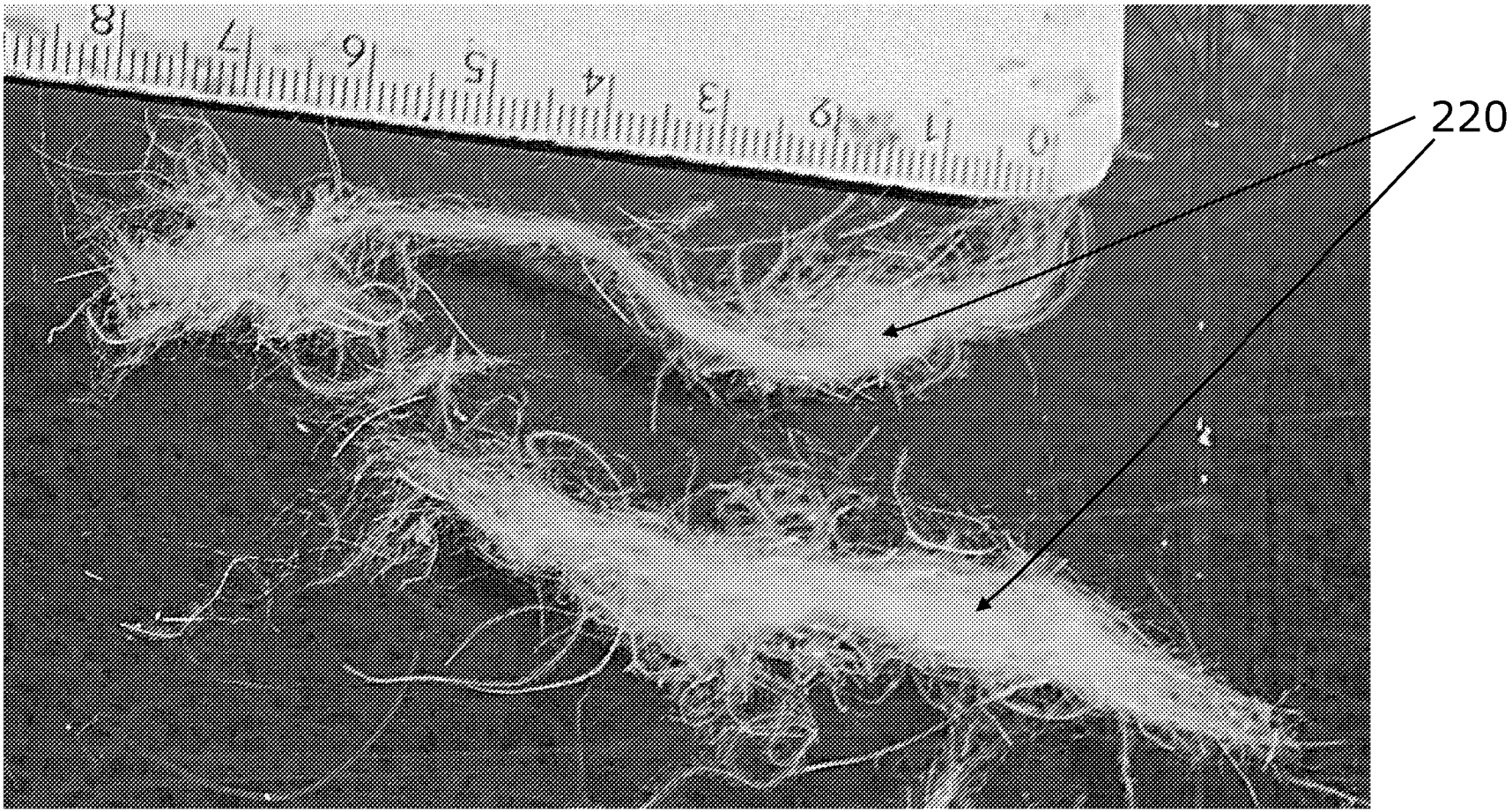
FIG. 8 is a view of disentangled vegetable kapok fibres according to the invention.

The elementary filaments 210 and the disentangled vegetable kapok fibres 220 are shown in FIGS. 7 and 8 respectively.

Figure 2:
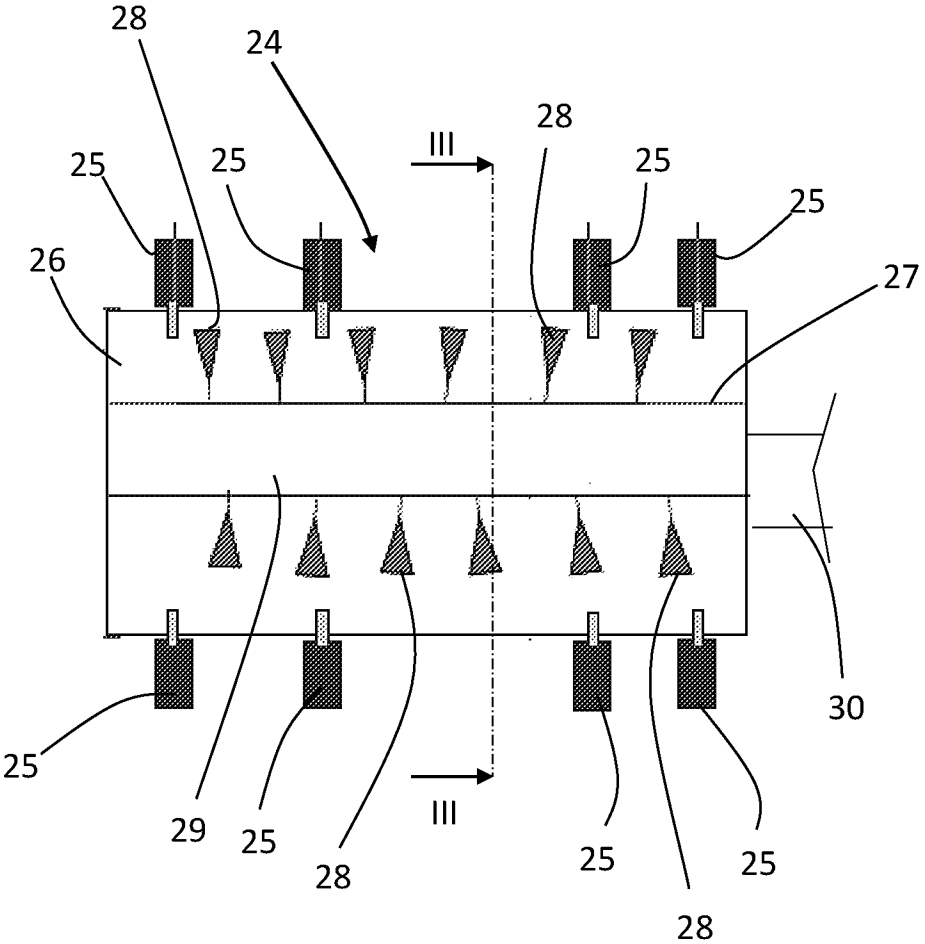
Figure 5:
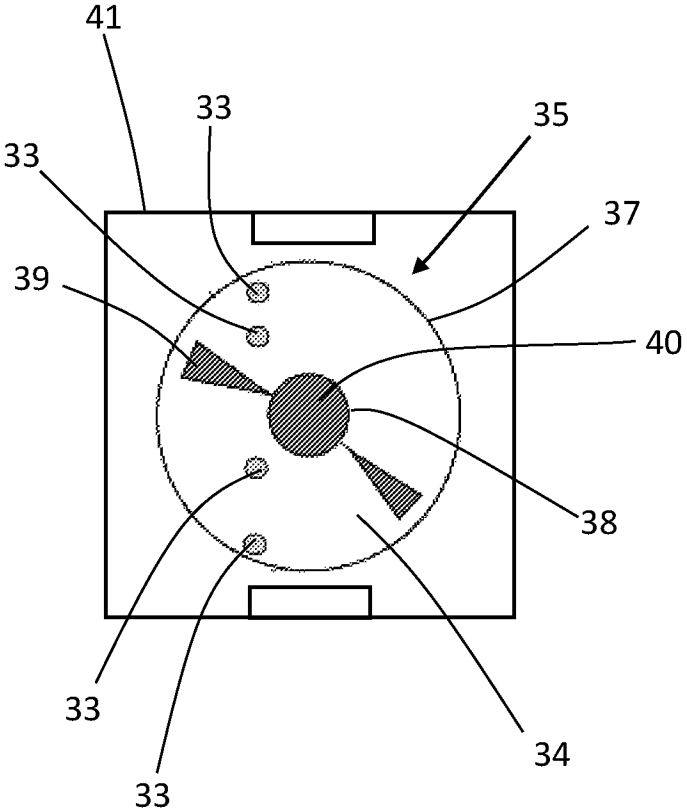
FIGS. 4 and 5 are schematic representations of a further detail of the plant in FIG. 1.

As better shown in FIG. 2 and in order to implement this step of partially disentangling the vegetable kapok fibre, the pre-treatment chamber 24 comprises a plurality of nozzles 25, for example eight nozzles 25, configured to deliver a suitable pressurized fluid, for example and preferably, compressed air, within the pre-treatment chamber 24.

Preferably, each nozzle 25 faces an internal volume 26 of the pre-treatment chamber 24 and is oriented to direct straight jets of the pressurized fluid towards said internal volume 26.

Preferably, the feeding nozzles 25 are arranged according to a plurality of pairs, in this exemplary case four pairs, positioned at substantially opposite parts of the pre-treatment chamber 24.

Preferably, the feeding nozzles 25 are arranged in arrays positioned at transversely opposite parts with respect to a longitudinal axis of the pre-treatment chamber 24.

The nozzles 25 are connected in a manner known per se to a source of pressurized fluid, for example in this case, compressed air, and are configured to feed compressed air at a pressure greater than 0.1 MPa, for example between 0.6 Mpa and 0.7 Mpa, within the pre-treatment chamber 24 and against the vegetable kapok fibre.

Preferably, the feeding nozzles 25 feed compressed air into the pre-treatment chamber 24 during the transit of the vegetable kapok fibres within the pre-treatment chamber 24.

Conveniently, the pre-treatment chamber 24 is not hermetically sealed but is in fluid communication with the external environment to prevent the internal pressure from equalizing the feeding pressure of the feeding nozzles 25.

Preferably, the conveyor device for the vegetable kapok fibre weighed by the weighing device 23 introduces successive portions of vegetable kapok fibre into the pre-treatment chamber 24 in such a way that the feeding nozzles 25 act on limited portions of the entire amount of vegetable kapok fibre that must be subsequently mixed with the down in the mixing chamber 16.

In particular, the conveyor device and the pre-treatment chamber 24 are preferably configured such that the ratio between the weight (in kilograms) of the vegetable kapok fibre present in the pre-treatment chamber 24 and the volume of the container measured in cubic metres is between 0.5 and 10, and, more preferably, between 1.0 and 6.0. In a particularly preferred embodiment, this ratio is between about 2.0 and 4.8.

By way of example, in a preferred embodiment the pre-treatment chamber 24 has a length of about 1.4 metres, a width of about 0.35 metres and a height of about 0.65 metres.

Preferably, each portion of vegetable kapok fibre introduced into the pre-treatment chamber 24 has a weight between 0.5 and 0.8 kilograms.

Preferably, the vegetable kapok fibre is fed in successive portions and continuously into the pre-treatment chamber 24 so that it travels through the latter before reaching the mixing chamber 16.

By way of example, an amount of about 1.5 kg of vegetable kapok fibre is fed in successive portions and continuously into the pre-treatment chamber 24, taking about 3 minutes to pass completely and continuously through the pre-treatment chamber 24.

In the preferred embodiment illustrated, the pre-treatment chamber 24 comprises a rotating comb 27 arranged within the chamber and rotatable about a substantially horizontal axis that preferably extends along the entire length of the pre-treatment chamber 24.

Advantageously, the rotating comb 27 operates in the internal volume 26 of the pre-treatment chamber 24 and acts on the vegetable kapok fibre to help holding the fibre in suspension within the pre-treatment chamber 24 and expose the same more efficiently to the jets of compressed air delivered by the nozzles 25.

In the context of this preferred embodiment of the invention, this action of holding the vegetable kapok fibre in suspension within the pre-treatment chamber 24 is mainly carried out by the compressed air itself and is assisted by the rotating comb 27.

Preferably, the rotating comb 27 comprises a plurality of blades 28 radially extending from a central shaft 29.

Within the framework of this preferred embodiment, the central shaft 29 rotates about a horizontal axis of rotation, driving the blades 28 in rotation.

Within the framework of this preferred embodiment, therefore, the rotating comb 27 keeps the vegetable kapok fibres in constant motion in the pre-treatment chamber 24 during the feeding of compressed air.

Figure 3:
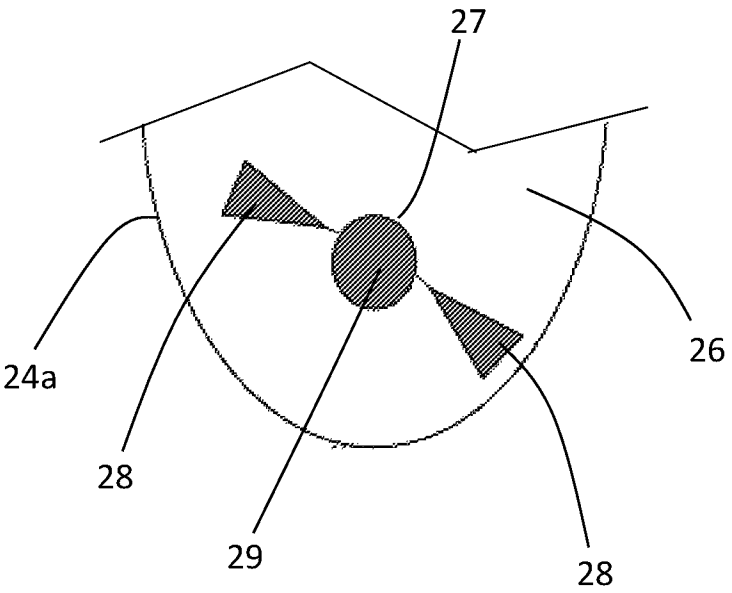
FIGS. 2 and 3 are schematic representations of a detail of the plant of FIG. 1.

Preferably, and as best illustrated in FIG. 3, the pre-treatment chamber 24 comprises a bottom curved wall 24*a* to define a concavity facing the internal volume 26 of the pre-treatment chamber 24.

Preferably, the bottom curved wall 24*a* has a development that is at least partly parallel to the trajectory followed by the blades 28 of the rotating comb 27.

Preferably, at an axial end of the pre-treatment chamber 24 there is an outlet 30 for the elementary filaments 210 and the disentangled vegetable kapok fibres 220 obtained from the said step of partial disentangling the vegetable kapok fibre carried out in the pre-treatment chamber 24.

Preferably, the outlet 30 is at a lower pressure with respect to the internal volume 26 of the pre-treatment chamber 24 in such a way that the elementary kapok filaments 210 and the disentangled vegetable kapok fibres 220 are sucked into the outlet 30.

In this preferred embodiment, the elementary kapok filaments 210 and the disentangled vegetable kapok fibres 220 are sent to the mixing chamber 16.

This transfer operation is preferably carried out by means of a pneumatic transfer line 31 connecting the outlet 30 of the pre-treatment chamber 24 to an inlet 32 of the mixing chamber 16.

The pneumatic transfer line 31 may be a conduit with diameter between 10 and 30 centimetres, for example 20 centimetres, in which a pressure difference is created between the outlet 30 from the pre-treatment chamber 24 and the inlet 32 into the mixing chamber 16. The pressure difference is such that the pressure at the outlet 30 is lower than the pressure at the inlet 32, so as to create an air flow that transports the elementary filaments 210 and the disentangled vegetable kapok fibres 220 into the mixing chamber 16.

Alternatively, the kapok fibre is directly fed to the mixing chamber 16 without passing through the pre-treatment chamber 24 or passing through the pre-treatment chamber 24 but without any jet of compressed air being directed onto the vegetable kapok fibres.

When the elementary filaments 210 and the disentangled vegetable kapok fibres 220 enter the mixing chamber 16, this preferred embodiment of the method comprises separating further elementary kapok filaments 210 unbound from each other from the disentangled vegetable kapok fibres 220 in the mixing chamber 16 by directing jets of a pressurized fluid, for example also in this case compressed air, against the vegetable kapok fibre as a whole and in particular against the disentangled vegetable kapok fibres 220.

Figure 4:
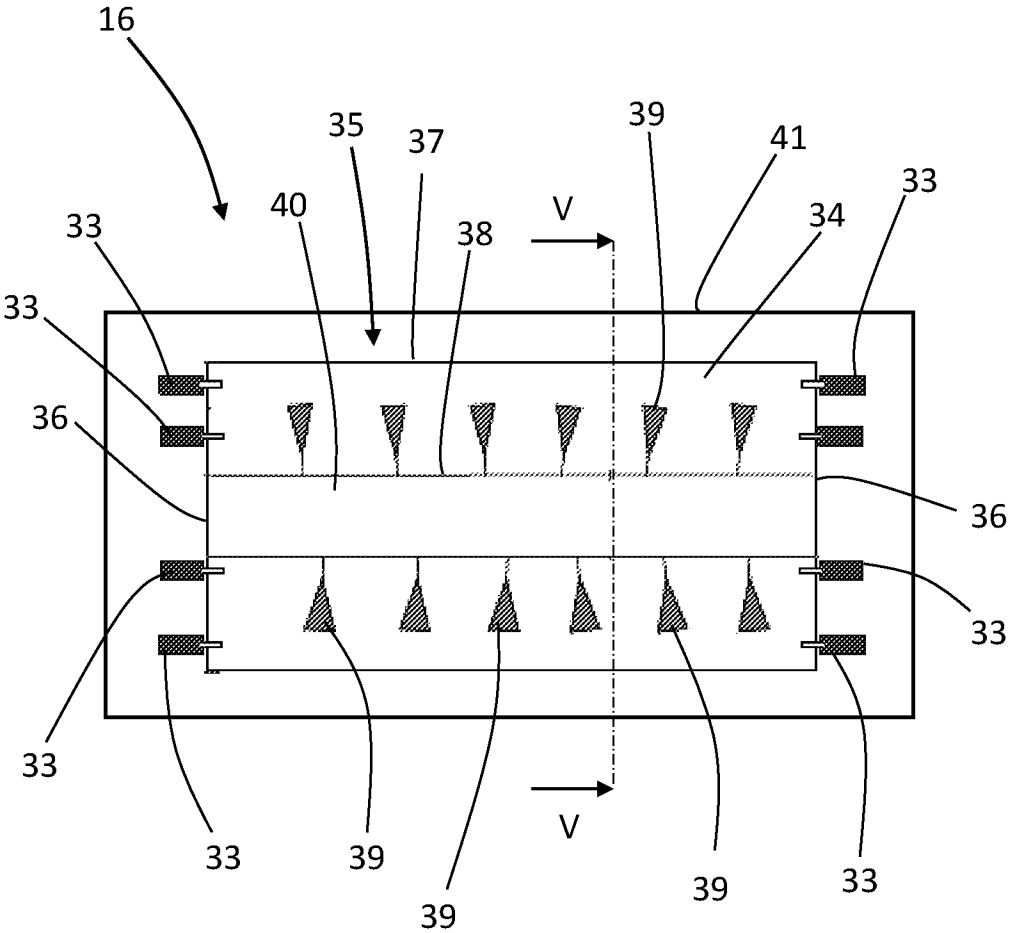

To this end and as schematically shown in FIG. 4, the mixing chamber 16 comprises a plurality of feeding nozzles 33, for example eight nozzles 33, configured to deliver directed jets of a suitable pressurized fluid, for example and preferably compressed air, within the mixing chamber 16.

Preferably, each nozzle 33 faces an internal volume 34 of the mixing chamber 16 and is oriented to direct straight jets of the pressurized fluid towards said internal volume 34.

Preferably, the nozzles 33 are arranged according to a plurality of pairs, in this exemplary case four pairs, positioned at substantially opposite parts of the mixing chamber 16.

Preferably, the nozzles 33 are arranged according to arrays positioned at longitudinally opposite parts with respect to a longitudinal axis of the mixing chamber 16.

The nozzles 33 are connected in a manner known per se to a source of pressurized fluid, for example in this case, compressed air, and are configured to deliver compressed air at a pressure greater than 0.1 MPa, for example between 0.6 Mpa and 0.7 Mpa, within the mixing chamber 16 and against the vegetable kapok fibre present therein.

In this preferred embodiment, the vegetable kapok fibre present within the mixing chamber 16 essentially consists of the elementary filaments 210 and of the disentangled vegetable kapok fibres 220 previously obtained from the step of partial disentangling the kapok fibre carried out in the pre-treatment chamber 24.

Advantageously, by directing the jets of compressed air delivered by the nozzles 33 against the vegetable kapok fibre, it is possible to separate further elementary kapok filaments 210 unbound from each other from the disentangled vegetable kapok fibres 220 in the mixing chamber 16.

Advantageously, furthermore, the jets of compressed air delivered by the nozzles 33 prevent the elementary filaments 210 from aggregating again with each other or with the disentangled vegetable kapok fibres 220.

Subsequent to the introduction of the kapok into the mixing chamber 16 or simultaneously with the introduction of the kapok into the mixing chamber 16, the method of the invention comprises feeding the goose and/or duck down 100 into the mixing chamber 16.

Following such feeding of the down 100, the step of incorporating the elementary kapok filaments 210 unbound from each other into the flakes 101 of the down 100 is carried out in the mixing chamber 16 by mixing the elementary kapok filaments 210 and the down 100 by means of the jets of compressed air delivered by the nozzles 33.

In particular, within the mixing chamber 16, the elementary kapok filaments 210 join the down 100 in such a way as to bind themselves to the barbules 102 of the flakes 101 and be inserted into the flakes 101 themselves.

In order to carry out this incorporation process, the feeding nozzles 33 introduce compressed air into the mixing chamber 16 for the whole duration of the mixing process which, for example, may last about 5 minutes.

At the same time and analogously to what happens in the pre-treatment chamber 24, the directed jets delivered by the nozzles 33 facing the internal volume 34 of the mixing chamber 16 also carry out an additional disentangling of the vegetable kapok fibre to obtain disentangled vegetable kapok fibres 220 made of clusters of elementary filaments bound to each other and having a weight equal to or lower than 0.05 grams.

In an exemplary embodiment and as will better appear below, the step of disentangling the vegetable kapok fibres carried out in the mixing chamber 16 is such that about 66% by weight of the vegetable kapok fibre gives rise to elementary filaments 210 and about 34% by weight of the vegetable kapok fibre gives rise to disentangled vegetable kapok fibres 220 made of clusters of elementary filaments bound to each other and having a weight equal to or lower than 0.05 grams.

The Applicant has observed that by varying the residence time of the vegetable kapok fibres both inside the pre-treatment chamber 24 and inside the mixing chamber 16, the percentage of obtainable elementary filaments 210 and the percentage of the aforesaid disentangled vegetable kapok fibres 220 vary accordingly and in a mutually opposite way, i.e., in case of an increase in the residence time, the percentage of obtainable elementary filaments 210 increases and the percentage of the aforesaid disentangled vegetable kapok fibres 220 decreases, and vice versa in case of a decrease in the residence time.

Preferably and analogously to what is set forth above in relation to the pre-treatment chamber 24, the mixing chamber 16 is also not hermetically sealed but is in fluid communication with the external environment to prevent the internal pressure from equalizing the feeding pressure of the feeding nozzles 33.

Preferably, within the mixing chamber 16 the ratio between the sum of the weight of the introduced kapok and the weight of the introduced down 100 and the volume of the mixing chamber 16 measured in cubic metres is between 0.5 and 2. More preferably, this ratio is of about 1.

By way of example, in the preferred embodiment illustrated the mixing chamber 16 is defined in a stationary mixing cylinder 35 with horizontal axis of symmetry.

The mixing cylinder 35 is provided with a perforated side wall 37 and longitudinally opposite circular base walls 36. Preferably, the perforated side wall 37 of the mixing cylinder 35 comprises a plurality of holes preferably having diameters of a few millimetres (for example 0.9 to 1.2 mm).

Preferably, the length of the mixing cylinder 35 is about 1.7 metres and the diameter is about 1.7 metres.

As set forth above, the feeding nozzles 33 are preferably eight in number facing each other in pairs and are placed on the base walls 36 and side walls 37 (FIG. 4).

Preferably, the mixing chamber 16 comprises a rotating comb 38 rotatable about a substantially horizontal axis extending along the entire length of the mixing chamber 16 defined in the cylinder 35.

The rotating comb 38 operates in the internal volume 34 of the mixing chamber 16 and is intended to help holding the mixture contained in the mixing chamber 16 in suspension.

Advantageously, this action of holding the mixture in suspension is carried out in synergy with the jets of compressed air delivered into the mixing chamber 16 by the nozzles 33.

Preferably, the rotating comb 38 acts on the mixture of elementary filaments 210, on the disentangled vegetable kapok fibres 220 and on the down 100 throughout the mixing process.

Preferably, the rotating comb 38 comprises a plurality of blades 39 radially extending from a central shaft 40.

Preferably, the central shaft 40 rotates about the axis of symmetry of the mixing chamber 16 driving the blades 39 in rotation.

Preferably, the mixing cylinder 35 is contained in a prismatic housing 41.

Preferably, the step of mixing the down 100, the elementary filaments 210 and the disentangled vegetable kapok fibre 220 in the mixing chamber 16 may have a time span between about 2 minutes and about 12 minutes, for example of about 5 minutes, at the end of which the filling product is ready to be discharged from the mixing chamber 16 and stored in a manner known per se.

Figure 9:
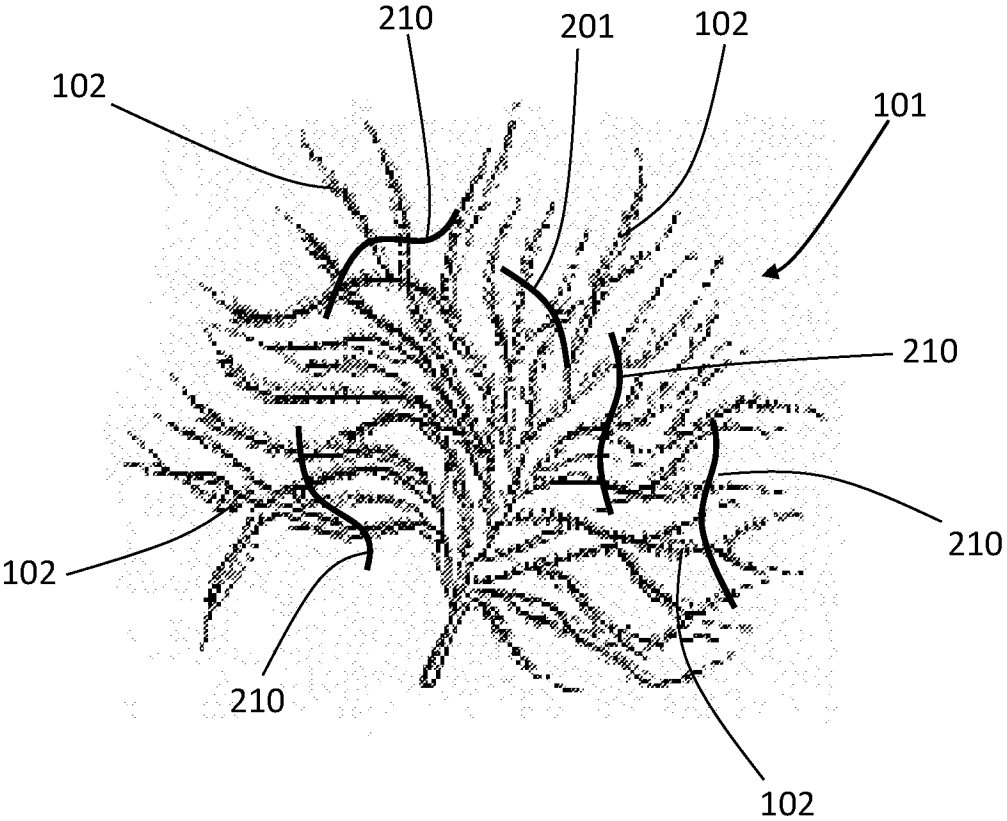
FIG. 9 is a schematic view of a hybrid down flake incorporating elementary kapok filaments.

FIG. 9 shows a schematic representation of how a sample consisting of down flakes 101 and elementary kapok filaments 210 inserted into the flakes 101 of the down 100 may look like. The elementary kapok filaments 210 have been inserted between the barbules 102 of the flakes 101 of the down 100, producing a hybrid flake which maintains almost unchanged the original properties of a native down flake 101.

The invention is now further illustrated by means of the following Examples, intended for illustrative and non-limiting purposes, of preparation and testing of a filling material comprising goose and/or duck down and vegetable kapok fibres according to the present invention and according to the prior art.

Example 1—Preparation and Analysis of a Filling Material According to the Invention A filling material comprising goose and/or duck down and vegetable kapok fibres was obtained starting from approximately 70 parts by weight of down and approximately 30 parts by weight of vegetable kapok fibre by implementing a preparation method as described in the previous paragraphs.

The filling material thus produced was analysed following the provisions of the IDFB (International Down and Feather Bureau) Testing Regulation protocol (version June 2020) with regard to cellulose-based fibres. The Applicant has in fact found that this protocol can also be effectively used to analyse the composition of down mixed with elementary filaments and kapok fibres, which are precisely cellulose-based fibres.

Specifically, this protocol explains how to prepare samples for analysing a composition of down mixed with cellulose-based fibres according to the definitions, tools and procedures referred to in the IDFB Testing Regulation part 3 (June 2020 version) entitled "Composition (Content Analysis)".

The composition of the filling material was analysed by completing the first separation required in paragraphs a) to c) of the IDFB Testing Regulation part 15-B.2 and without carrying out what is required in paragraphs d) to g) of the IDFB Testing Regulation part 15-B.2 (second separation) (version June 2013).

The filling material analysed in this way gave the results shown in Table 1 below.

TABLE 1

| Material | Amount (% by weight) |
|---|---|
| Down and fibres | 86.1 |
| Waterfowl feathers | 2.8 |
| Damaged feather | 1.8 |
| Feathers of land birds | 0.1 |
| Separable kapok fibres weighing lower than 0.05 g | 9.2 |
| Separable kapok fibres weighing more than 0.05 g | 0.0 |

In order to determine the actual total amount of down and kapok fibre present in the filling material, the latter was analysed according to the provisions of the IDFB Testing Regulation protocol part 15-D (version June 2019) entitled "Chemical Separation of Down and Feathers Blended with Cellulose". This protocol explains how to separate down from cellulose. The Applicant has found that this protocol can also be effectively used to separate down from kapok.

The reported results of this further analysis are shown in Table 2 below.

TABLE 2

| Material | Amount (% by weight) |
|---|---|
| Down and Feathers | 72.8 |
| Kapok | 27.2 |

In order to calculate the % by weight of manually separable kapok weighing lower than 0.05 g, the formula was applied: % cellulose<0.05 g manually separated/% cellulose found by chemical separation according to IDFB Testing Regulation part 15-D.

In this case: 9.2%/27.2%=33.7%.

In order to calculate the % by weight of manually separable kapok weighing more than 0.05 g, the formula was applied: % cellulose>0.05 g manually separated/% cellulose found by chemical separation according to IDFB Testing Regulation part 15-D.

In this case: 0%/27.2%=0%.

The calculation of the % by weight of perfectly mixed kapok (i.e. the % by weight of elementary kapok filaments retained by the barbules and therefore not mechanically separable from the flakes) was carried out using the formula: 100%−(sum of total percentage of unmixed Kapok).

In this case: 100%−(33.7%+0%)=66.3%.

Example 2—Preparation and Analysis of a Comparative Filling Material

A comparative filling material comprising goose and/or duck down and vegetable kapok fibres was prepared starting from about 70 parts by weight of down and about 30 parts by weight of vegetable kapok fibre using the same plant as described in the previous paragraphs without any feed of pressurized fluid jets and by only actuating the combs 27 and 38.

This to simulate the purely mechanical treatments of disentangling the vegetable fibre and of mixing it with the down, as provided for by the prior art.

The filling material had a very uneven structure with partially disentangled kapok fibres grouped together to form agglomerates weighing more than 0.05 g, which did not allow significant and reproducible results to be obtained in the tests carried out according to the above-mentioned IDFB protocol. This is because of the extreme variability in composition between the samples.

In this case, therefore, it was not possible to determine the presence and relative amount of elementary kapok filaments embedded in the down flakes. In any event, the Applicant has observed that the % by weight of partially disentangled kapok fibres weighing more than 0.05 g was on average higher than 30%.

Example 3—Assessment of Water Repellency of the Filling Material According to Example 1

The filling material obtained according to the example was also analysed following the provisions of the IDFB Testing Regulation part 18-A protocol (June 2015 version) entitled "Hydrophobic Shake Test".

This protocol explains how to assess the water repellency of the composition and allows information to be inferred about the degree of mixing between the kapok fibres (which tend to float on the liquid) and down (which tend to soak and sink into the liquid).

The filling material according to Example 1 (invention) after 100 minutes of Shake test reached a level 3 (Bulk down is half way under water), whereas a reference filling material including only down reached after 100 minutes a level 5 (Down completely submerged under water—complete saturation).

This result confirms that in the filling material obtained according to Example 1 according to the invention, an optimal mixing of kapok and down takes place. In this case, the kapok is in fact able to exert its floating action on the filling material under the shake test conditions.

Conversely, the filling material including only down resulted as completely soaked and submerged under the shake test conditions.

What is claimed is:

1. A filling material comprising goose and/or duck down and vegetable kapok fibres, comprising:

a) hybrid goose and/or duck down comprising elementary kapok filaments not tied to one another, the elementary kapok filaments being incorporated in flakes of goose and/or duck down in an amount equal to or greater than 10% by weight of the total weight of kapok, and b1) goose and/or duck down, and b2) disentangled kapok fibres, made of clusters of elementary kapok filaments bound to each other and not incorporated in the flakes of goose and/or duck down, and having a weight equal to or greater than 0.05 g, and in an amount equal to or lower than 20% by weight of the total weight of kapok.

2. The filling material according to claim 1, wherein the disentangled kapok fibers are in an amount equal to or lower than 15% by weight of the total weight of kapok.

3. The filling material according to claim 1, comprising a total amount of vegetable kapok fibres between 5% and 80% by weight of the total weight of the filling material.

4. The filling material according to claim 1, comprising a total amount of vegetable kapok fibres between 10% and 75% by weight of the total weight of the filling material.

5. The filling material according to claim 1, comprising a total amount of vegetable kapok fibres between 10% and 50% by weight of the total weight of the filling material.

* * * * *